US008292385B2

(12) United States Patent
Bracke et al.

(10) Patent No.: US 8,292,385 B2
(45) Date of Patent: Oct. 23, 2012

(54) INK SUPPLY SYSTEM WITHOUT PUMP, FOR INK JET PRINTER WITH INK RECIRCULATION SYSTEM

(75) Inventors: Peter Bracke, Drongen (BE); Davy De Vetter, Lochristi (BE)

(73) Assignee: Agfa Graphics NV, Mortsel (BE)

( * ) Notice: Subject to any disclaimer, the term of this patent is extended or adjusted under 35 U.S.C. 154(b) by 190 days.

(21) Appl. No.: 12/920,867

(22) PCT Filed: Feb. 27, 2009

(86) PCT No.: PCT/EP2009/001429

§ 371 (c)(1),
(2), (4) Date: Sep. 3, 2010

(87) PCT Pub. No.: WO2009/109342

PCT Pub. Date: Sep. 11, 2009

(65) Prior Publication Data

US 2011/0007106 A1 Jan. 13, 2011

Related U.S. Application Data

(60) Provisional application No. 61/034,501, filed on Mar. 7, 2008.

(30) Foreign Application Priority Data

Mar. 7, 2008 (EP) ..... 08102374

(51) Int. Cl.
*B41J 29/38* (2006.01)

(52) U.S. Cl. ..... 347/6; 347/7; 347/84

(58) Field of Classification Search ..... 347/5–7, 347/14, 17, 19, 84–87
See application file for complete search history.

(56) References Cited

U.S. PATENT DOCUMENTS 6,935,729 B2 * 8/2005 De Marco et al. ..... 347/73
2007/0268346 A1 11/2007 Nishida

FOREIGN PATENT DOCUMENTS

JP 58-219069 A 12/1983
WO 2005/002860 A1 1/2005
WO 2006/064036 A1 6/2006

OTHER PUBLICATIONS

Official Communication issued in International Patent Application No. PCT/EP2009/001429, mailed on May 25, 2009.

* cited by examiner

*Primary Examiner* — Juanita D Jackson
(74) *Attorney, Agent, or Firm* — Keating & Bennett, LLP

(57) ABSTRACT

An ink supply system for an industrial inkjet printer makes use of a least one buffer vessel wherein ink at low pressure is isolated and pressurized to a high pressure suited for feeding the ink to the printhead. A recirculation ink supply system using plural buffer vessels is suited for repressurizing the ink without the use of a pump. The system avoids generation of gas bubbles due to cavitation which are present in systems using a pump for repressurizing ink.

19 Claims, 5 Drawing Sheets

FIG. 1 — PRIOR ART

INK SUPPLY SYSTEM WITHOUT PUMP, FOR INK JET PRINTER WITH INK RECIRCULATION SYSTEM

CROSS-REFERENCE TO RELATED APPLICATIONS

This application is a 371 National Stage Application of PCT/EP2009/001429, filed Feb. 27, 2009. This application claims the benefit of U.S. Provisional Application No. 61/034,501, filed Mar. 7, 2008, which is incorporated by reference herein in its entirety. In addition, this application claims the benefit of European Application No. 08102374.9, filed Mar. 7, 2008, which is also incorporated by reference herein in its entirety.

BACKGROUND OF THE INVENTION

1. Field of the Invention

The present invention relates to a method for supplying ink to an inkjet printhead in an inkjet apparatus. More specifically the invention is related to a method for supplying ink to a printhead ink in an inkjet printer having a recirculation ink supply system.

2. Description of the Related Art

Nowadays a lot of printed matter is produced carrying a reproduction of a color image. A large part of these color prints in office and home environment are made using inkjet printers.

In an inkjet printer drops of ink are jetted out of nozzles of an inkjet printhead towards a receiving layer which may be e.g. specially coated paper.

Usually an inkjet print head has an array of nozzles, each nozzle jetting ink to a different location possibly at the same time.

The ink is jetted out of the nozzles by use of e.g. thermal or piezoelectric actuators creating a pressure wave.

It is normally the intention that the size of the droplets can be kept constant or that there is a good control of the droplet size in printers capable of recording variable droplet sizes.

One of the major parameters to ensure a constant drop size is that ink pressure at the printhead is stable and within a certain range suitable for the printhead used.

The pressure can be kept constant using several methods:

For small inkjet printers often a negative pressure generating member is present in the ink reservoir mounted on the shuttle carrying the printhead.

In larger printers and industrial inkjet printers an ink tank is often equipped with a system regulating and stabilizing the pressure in the tank by directly controlling the ink pressure or the pressure of the air (atmosphere) above the ink.

In the PCT application PCT/EP2005/056809 an ink supply system, depicted in FIG. 1, for an ink jet printer is disclosed, wherein one or more ink jet print heads 1 receive ink from an ink supply tank 2. The printhead is of a throughflow type and ink circulates further to an ink return tank 3. The ink is pumped back to the ink supply tank 2 by a circulation pump 4 thereby passing trough a degassing unit 5. If additional ink is required in this circuit, it is added from main ink tank 6 by the ink feed pump 7.

In FIG. 1 the circulation through the printhead is determined only by the pressure difference between the ink supply tank 2 and the ink return tank 3. This can be generated by keeping an exact ink level difference between the ink level in the supply tank 2, remaining at a higher ink level than the level in the return tank 3, as shown in FIG. 1, or by providing a regulation system for providing regulated pressures in the supply and return tank. Another possibility is that the ink supply tank is mounted physically higher than the return tank whereby a level difference can be guaranteed.

As the "hydrostatic" or regulated pressure in the supply tank is higher that of the return tank, the ink supply tank 2 can be considered to be part of the "high" pressure section of the ink feed system while the ink return tank 3 is part of the low pressure section of the ink supply system.

As the ink flows continuously from the high pressure supply tank 2 to the low pressure return tank 3 the ink has to be re-pumped from the low pressure section to the high pressure section of the ink supply system by the circulation pump 4.

A disadvantage of this ink supply system is that gas bubbles may be created in the ink due to cavitation phenomenae in the circulation pump 4. If gas bubbles enter the print head 1, nozzles may be blocked, resulting in unreliable operation of the printer. The pump 4 may also introduce sudden level differences or pressure changes in the high pressure section.

It is clear that there is need for a method for pressurizing the ink in an inkjet printer during feeding or recirculation of the ink without the mentioned drawbacks caused by a pump.

SUMMARY OF THE INVENTION

The above-mentioned advantageous effects are realized by a method having the specific steps set out below. Specific features for preferred embodiments of the invention are also set out below. An ink supply system for using the method according to the present invention is set out below.

Further advantages and embodiments of the present invention will become apparent from the following description and drawings.

DETAILED DESCRIPTION OF THE PREFERRED EMBODIMENTS

Feeding the ink to a high pressure ink supply section without the aforementioned drawbacks is solved by a method for feeding ink in an ink jet printer wherein ink vessels are used for pressurizing ink instead of pumps. An advantage is that no gas bubbles due to pump cavitation will be created.

While the present invention will hereinafter be described in connection with preferred embodiments thereof, it will be understood that it is not intended to limit the invention to those specific embodiments.

Figure 1:
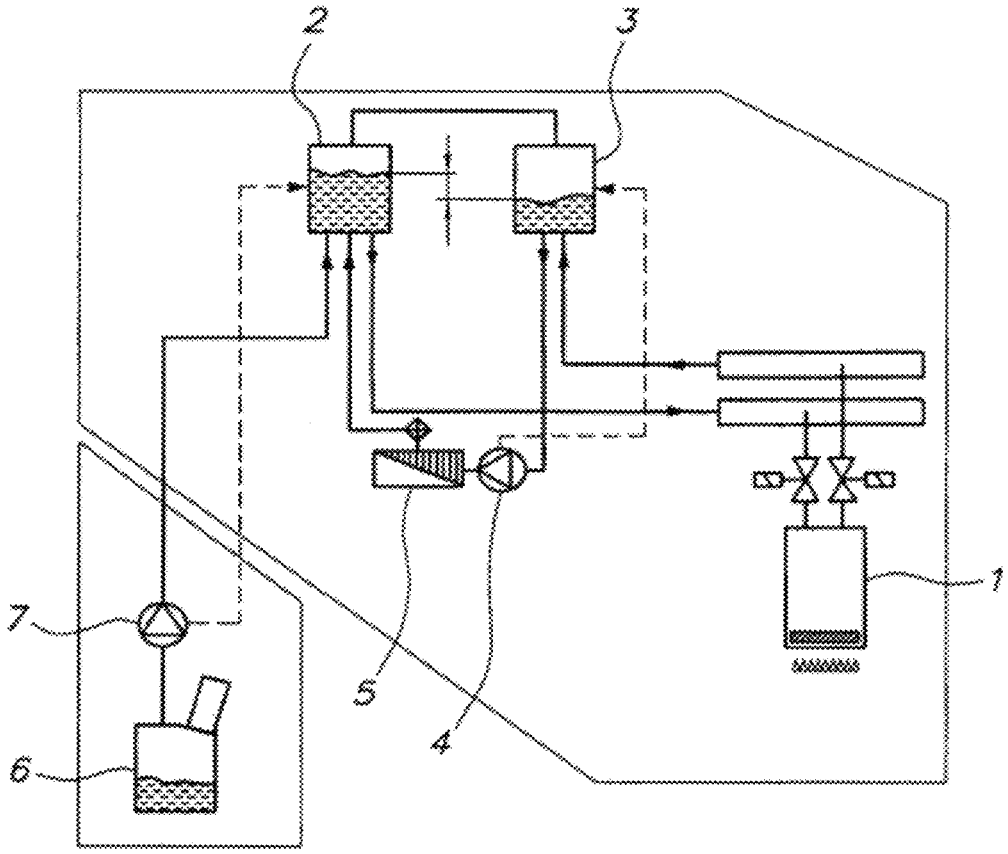
FIG. 1 shows a prior art ink supply system for an industrial printer using a circulation pump.
Figure 2:
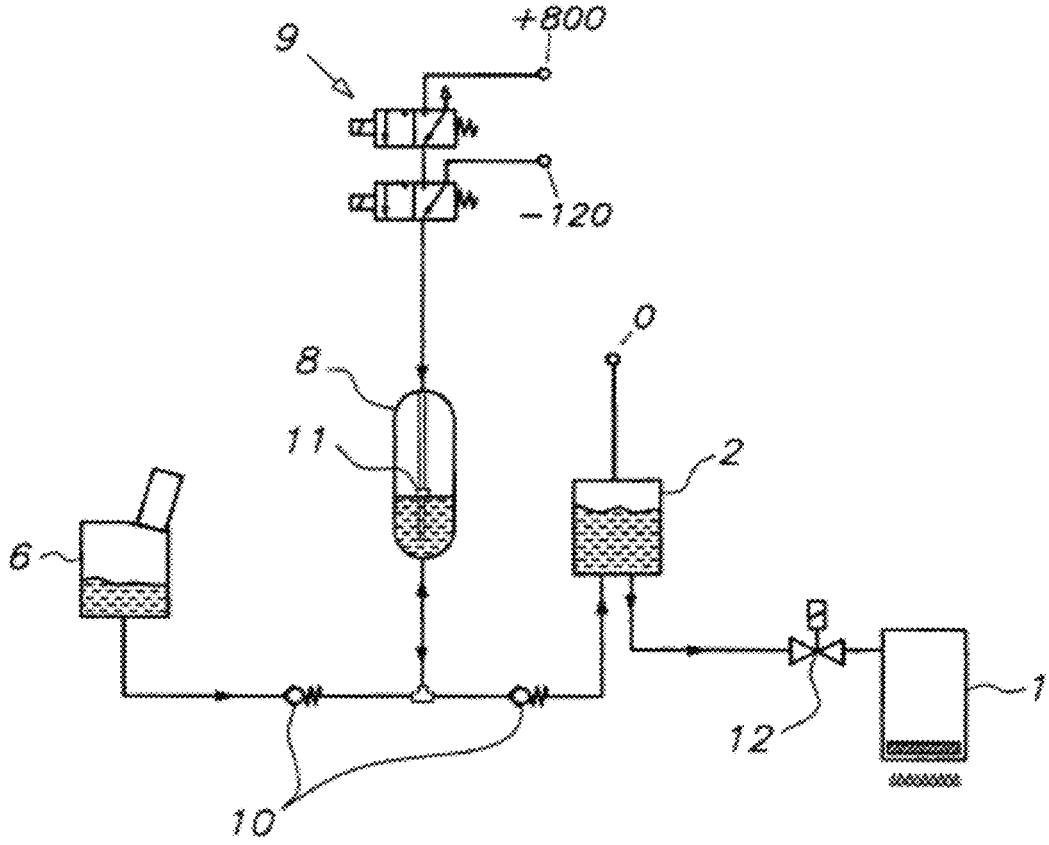
FIG. 2 shows the principle of supplying ink using a pressure vessel.

The principle and its most simple preferred embodiment is depicted in FIG. 2.

The printhead 1 used in FIG. 2 is a printhead which is not based upon circulation through the printhead 1. This means the ink is fed once to the printhead 1 from e.g. an ink supply header tank 2 and the ink amount to be fed to the printhead 1 is the same as the total consumption due to printing, spitting during maintenance, etc.

No ink will return from the printhead 1 to the ink supply system during normal operation. We consider this feed system to be a high pressure ink supply section for the printhead 1 as the flow of ink is from the ink supply header tank 2 in the feed system to the printhead 1. This does however not mean that the "hydrostatic" pressure in the system elsewhere is always lower than the pressure in the header tank 2 which feeds ink to the printhead, it can be understood that e.g. the pressure in the printhead 1 can be higher due to a height difference, but the flow is always directed from the ink supply header tank 2 to the printhead 1.

Ink is fed by the system from a main ink tank 6 to counteract the consumption by the printhead 1.

In the ink supply section, a buffer tank 8 is provided coupled to a pressure regulation system 9 controlling the pressure in the buffer tank 8.

Replenishment of ink to the system is done from a main ink tank 6 which can also be a small canister. The main ink tank 6 is normally at an ambient air pressure.

The feeding of the ink from the main ink tank 6 to the high pressure system is done using the method having the following steps:

- the ink at low pressure is isolated in a buffer vessel 8 which is separate from the high pressure ink supply section.
- the pressure inside the buffer vessel 8 is raised by the pressure regulation system 9 thereby pressurizing the ink contained in the buffer vessel 8.
- the buffer vessel 8 is then connected to the high pressure ink supply section
- the pressurized ink is fed to the high pressure ink supply section.

To isolate the ink in the buffer vessel 8 as mentioned in the first step, the ink has to enter the buffer vessel 8 which could be done using gravity making the ink flow into the buffer vessel 8. In FIG. 2 however the ink is drawn from the main ink tank 6 into the buffer vessel by providing a negative pressure using the pressure regulation system 9. The pressure used in this case is about −120 mbar. As a result the buffer tank 8 is slowly filled with ink. No reverse flow is possible as in this preferred embodiment a check valve 10 is incorporated into the ink channel.

A system using e.g. a float 11 detects the level of ink into the buffer vessel 8 and the inflow of ink is stopped when a desired level is attained by disconnecting of the vessel 8 from the negative pressure resulting in raising of the internal pressure in the buffer vessel 8 or by use of an electronically controlled valve in the ink channel (not used in FIG. 2). Such a valve could also replace the check valve 10 shown in FIG. 2.

As a result a quantity of ink is now isolated in the buffer vessel 8. During the second step the pressure in the vessel 8 is raised thereby pressurizing the ink inside. The positive pressure which is applied in this preferred embodiment is about +800 mbar.

During the third step the buffer vessel 8 is connected to the high pressure ink supply section. This can happen using e.g.

- an electronically controlled valve which can be e.g. controlled by the level of ink in the header tank 2
- the opening of a check valve 10 between the buffer vessel 8 and the header tank 2 which opens at a certain pressure.

During the fourth step the pressurized ink is fed from the buffer vessel 8 to the high pressure ink supply section. It has to be avoided that the pressure in the header tank 2, which is part of the high pressure ink supply section, is disturbed by the sudden flow of ink into the tank 2. This can be done by electronically controlling the valve when using a controlled valve to ensure that only a limited amount of ink flows into the header tank 2 supplying ink to the printhead 1.

This limitation can also be obtained by the automatic closing of the check valve 10 as the pressure difference between the buffer vessel 8 and the header tank 2 lowers as the pressure of the buffer vessel 8 lowers below the +800 mbar value, this lowering can be caused by the outflow of ink from the buffer vessel 8 to the header tank 2 when the connection to the high pressure source is closed so that outflow of ink causes a pressure drop, or by a fast deliberate lowering the +800 mbar pressure inside the buffer vessel 8 by letting pressure escape from the buffer vessel.

When all the ink from the buffer tank 8 is fed slowly to the header tank 2, which means the same amount of ink has passed through the printhead 1, the pressure in the buffer vessel 8 can be lowered again to a negative value and new ink is drawn from the ink reservoir 6.

Figure 3:
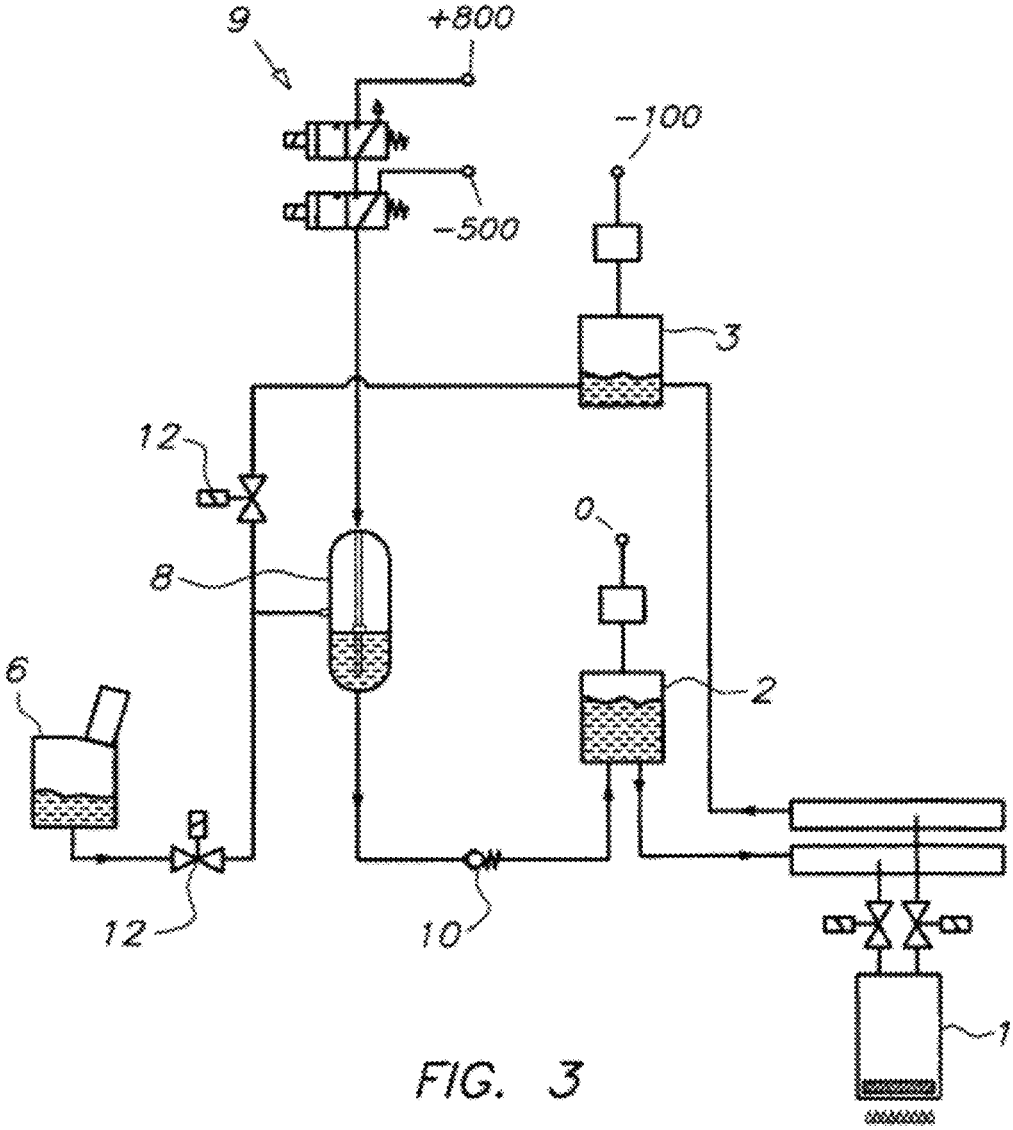
FIG. 3 shows a re-circulation type ink supply using a single re-pressurizing vessel.

A second preferred embodiment of the invention is illustrated by FIG. 3.

The printer has here a recirculation ink supply system and uses e.g. a printhead which is of a throughflow type.

The printhead 1 is supplied with ink from the "high" pressure supply section of the ink supply system and only uses a part of the ink to record an image on a receiver, a large part of the ink delivered to the printhead flows 1 back to the "low" pressure ink supply section for receiving ink from the printhead 1 and the ink is then reused.

At the bottom right of FIG. 3. the printhead 1 is shown which is coupled to the ink supply system of the shuttle which is connected to header tanks 2,3 for feeding ink to the shuttle/printhead and receiving reflow ink from the shuttle/printheads.

The same steps as in the first preferred embodiment are used:

- the ink at low pressure is isolated in a buffer vessel 8 which is separate from the high pressure ink supply section.
- the pressure inside the buffer vessel 2 is raised using the pressure regulating system 9 thereby pressurizing the ink contained in the buffer vessel 8.
- the buffer vessel 8 is then connected to the high pressure ink supply section.
- the pressurized ink is fed to the high pressure ink supply section.

An additional step is however present:

- draining low pressure ink from the low pressure ink supply section into the buffer vessel 8.

During this extra step the ink reflow from the shuttle which was collected in the ink return header tank 3 is, depending upon the ink level in the return header tank 3 drained into the buffer vessel 8 as follows. The ink return header subtank 3 is connected to the buffer vessel 8 by opening the controlled valve 12. As the pressure inside the buffer vessel 8 is set lower than the pressure in the return header tank 3 the ink is drained from the tank 3 to the buffer vessel 8. When all ink is evacuated, the valve can be closed again. This evacuation action can be repeated until the buffer vessel 8 is full.

The further known steps are executed:

- The ink at low pressure is isolated into the buffer vessel 8 by the closing the valves.
- The pressure in the buffer vessel 8 is raised using the pressure regulating system 9 actuating the appropriate valves. The underpressure of −500 mbar on the buffer vessel 8 is replaced by a positive pressure of 800 mbar.

the buffer vessel 8 is connected to the high pressure ink supply section by opening the appropriate valves, electronically controlled or by automatic opening when using a check valve 10, the pressurized ink from the buffer vessel 8 is fed to the high pressure ink supply section.

Using this method the ink is re-fed from the low pressure supply section to the high pressure supply section without the use of pumps. Afterwards the same routine is repeated.

Using a single buffer vessel 8 however may pose problems. No ink can be drawn from the ink return header tank 3 during the re-fed of the ink to the ink feed header tank 2 which may result in an overflow of the return tank 3 or the occurrence of ink level deviations which may cause problems. A strict design of the different components may avoid such a situation. Using large ink header tanks 2,3 and a relative small buffer vessel 8 may solve such a problem.

Figure 4:
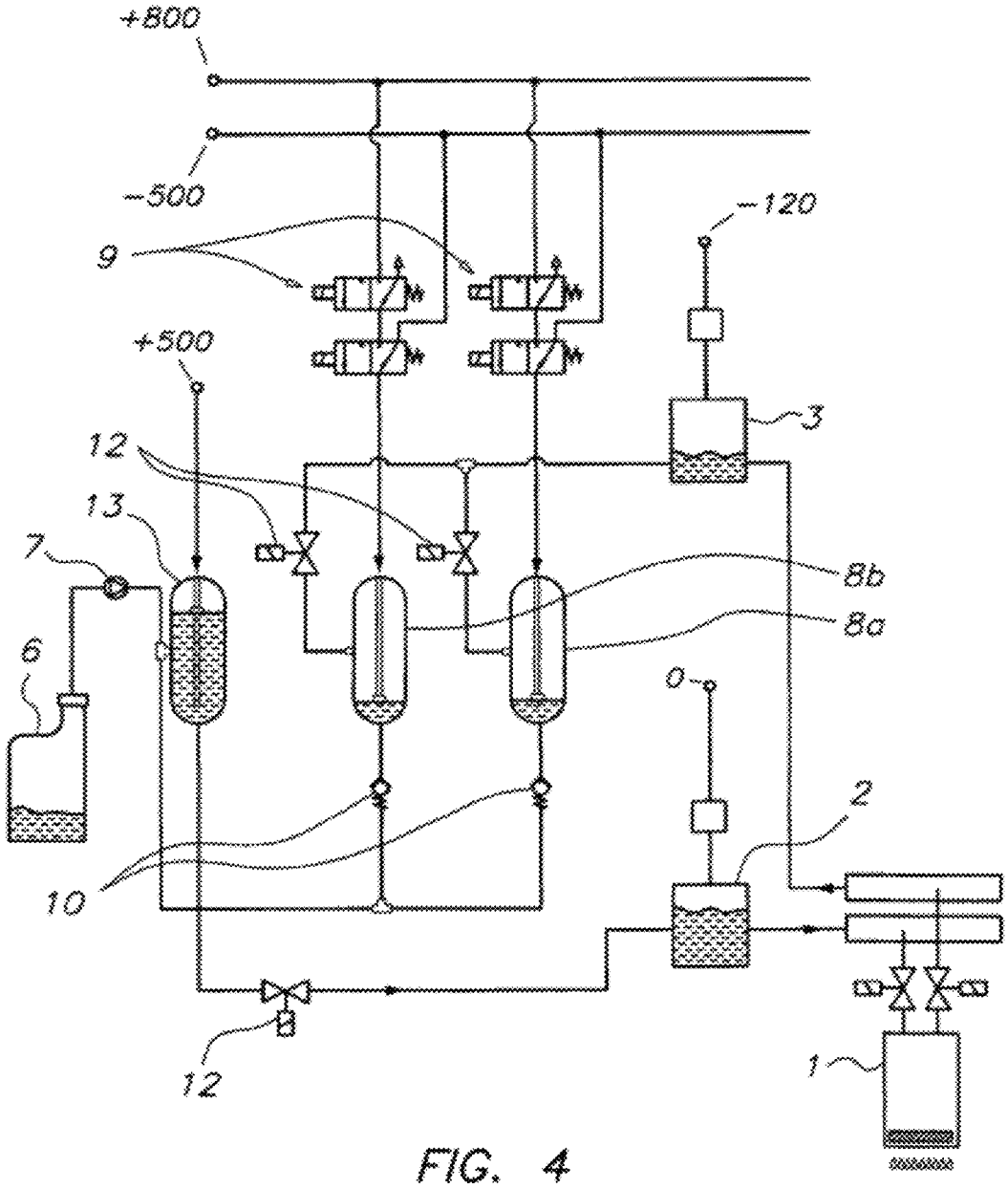
FIG. 4 shows a re-circulation type ink supply system using two re-pressurizing vessels which can be used alternating.

A more preferred embodiment, which avoids such problems is shown in FIG. 4. where 2 buffer vessels 8*a*,8*b* and a dedicated ink supply vessel 13 are available. As in the previous embodiment, the ink reflow from the shuttle is collected in the ink return header subtank 3 of which the ink level guarded. When this ink level reaches a specific height, the ink is evacuated as follows. The ink return header subtank 3 is connected to the first buffer vessel 8*a* by opening the appropriate valve 12. The first buffer vessel 8*a* is at −500 mbar, so that ink flows from the ink return header subtank 3 to the first buffer vessel 8*a* until a desired low level in the ink return header subtank is reached. Then, the connection to the first buffer vessel 8*a* is closed by closing the appropriate valve 12. This evacuation action can be repeated until the first buffer vessel 8*a* is full or has reached a desired level. After this, excess ink from ink return header subtank 3 is evacuated to the second buffer vessel 8*b* instead of the first buffer vessel 8*a*, and in the mean time, by using the appropriate pressure regulating system 9, the underpressure of −500 mbar on the first buffer vessel 8*a* is replaced by a pressure of +800 mbar and the first buffer vessel 8*a* is emptied into a dedicated ink supply vessel 13, without the use of pumps. If, after some time, the second buffer vessel 8*b* is full, a switch from the second to the first buffer vessel 8*a* occurs, so that excess ink is now evacuated again to the first buffer vessel 8*a*, and in the mean time the second buffer vessel 8*b* can be emptied into the ink supply vessel 13.

This dedicated ink supply vessel 13 is at a constant pressure of +500 mbar so ink can be fed at all times to the ink supply header tank 2 which is e.g. at ambient pressure (0 mbar) depending upon the level of the supply header tank 2. This is controlled by an intervening electronically controlled valve 12.

By having an ink supply system having at least two buffer vessels 8*a*,8*b*, at least two different steps can be done simultaneously using the different buffer vessels 8*a*,8*b*.

Using this method it is possible to obtain a continuous recirculation of the ink by using the different buffer vessels 8*a*,8*b* alternating so continuously ink can be drawn from the low pressure ink supply section and ink is fed to the high pressure ink supply section.

The step of isolating the ink at low pressure in at least one buffer vessel separated from the high pressure ink supply section preferably comprises the closing of valves in between the connection of the buffer vessel and the high and low pressure ink supply sections by controlled closing of electronically controlled valves 12 or the automatic closing of check valves 10.

When ink is to be supplied from the main ink reservoir 6 at the left due to consumption of ink during printing, an ink feed pump 7 can be used. This is not a problem as there is less risk for cavitation and a very low risk that air bubbles will reach the printhead 1. The circulation pump 4 in the prior art, which has to pump the ink from the return header tank 3 to the header feed tank 2 had however to suck ink at a already a low pressure (e.g. −120 mbar), which meant there was quite a risk for cavitation.

Therefore, in preferred embodiments of the present invention, this pump is replaced by the system of ink vessels at fixed and changing pressures.

Figure 5:
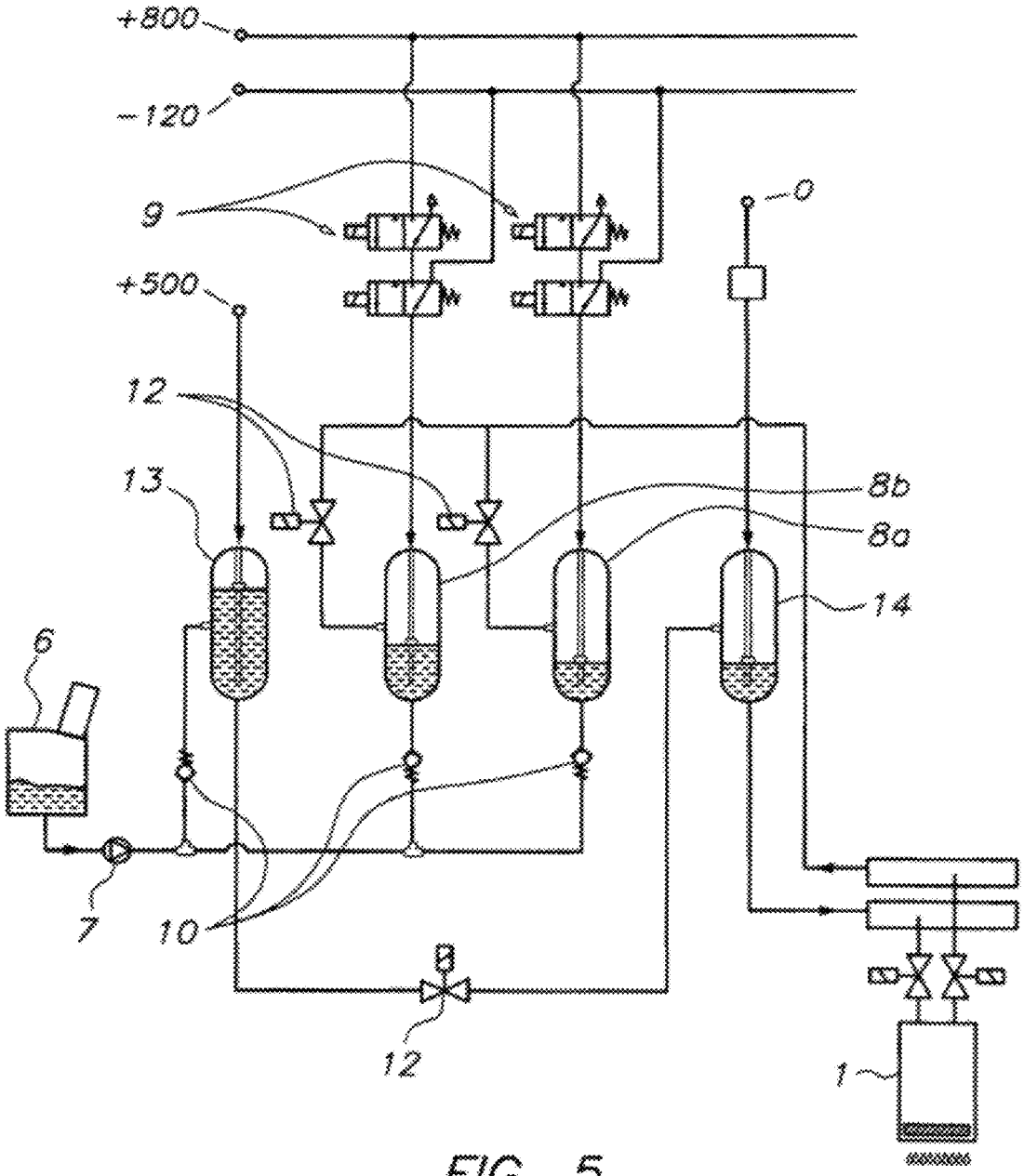
FIG. 5 shows a re-circulation type ink supply system using two re-pressurizing vessels, an ink supply vessel and a utility "in" vessel.

The preferred embodiment of FIG. 5 includes an additional utility in vessel 14 from which the shuttle is fed. Dedicated header supply and reflow tanks are omitted and can be located elsewhere on the shuttle itself.

Reflow of the shuttle is received directly in the two return vessels 8*a*,8*b*.

Having described in detail preferred embodiments of the current invention, it will now be apparent to those skilled in the art that numerous modifications can be made therein without departing from the scope of the invention as defined in the appending claims.

The invention claimed is:

1. A method for feeding ink in an ink supply system of an inkjet printer including a high pressure ink supply section arranged to feed ink to a printhead, the method comprising the steps of:

isolating ink at a low pressure in at least one buffer vessel separated from the high pressure ink supply section;

raising the pressure in the at least one buffer vessel thereby pressurizing the ink contained in the at least one buffer vessel;

connecting the at least one buffer vessel including the pressurized ink to the high pressure ink supply section; and feeding the pressurized ink from the at least one buffer vessel to the high pressure ink supply section.

2. The method according to claim 1, wherein the inkjet printer includes a recirculation ink supply system including a low pressure ink supply section arranged to receive ink from the printhead, the method further comprising the step of:

draining the low pressure ink from the low pressure ink supply section into the at least one buffer vessel.

3. The method according to claim 2, wherein the ink supply system includes at least two different buffer vessels, and wherein the ink supply system is capable of performing at least two different method steps simultaneously using the at least two different buffer vessels.

4. The method according to claim 3, wherein the at least two different buffer vessels are used alternatingly to obtain a continuous recirculation of the ink.

5. The method according to claim 3, wherein the step of isolating ink at low pressure in at least one buffer vessel separated from the high pressure ink supply section comprises the step of:

closing valves in between a connection of the at least one buffer vessel and the high pressure ink supply section.

6. The method according to claim 2, wherein the step of isolating ink at low pressure in at least one buffer vessel separated from the high pressure ink supply section comprises the step of:

closing valves in between a connection of the at least one buffer vessel and the high pressure ink supply section.

7. The method according to claim 1, wherein the step of isolating ink at low pressure in at least one buffer vessel separated from the high pressure ink supply section comprises the step of:

closing valves in between a connection of the at least one buffer vessel and the high pressure ink supply section.

8. An ink supply system for an inkjet printer wherein ink is recirculated by repressurizing the ink, the ink supply system comprising:

a high pressure ink supply section arranged to feed ink to at least one throughflow printhead;

at least one throughflow printhead arranged to jet ink to a receiver, the at least one throughflow inkjet printhead arranged to be fed by the high pressure ink supply section, and including a high pressure end and a low pressure end;

a low pressure ink supply section arranged to receive ink from the at least one throughflow printhead;

at least one buffer vessel arranged to drain low pressure ink from the low pressure ink supply section and to isolate the ink at low pressure from the high pressure ink supply section; and a pressurizing device arranged to pressurize the ink in the at least one buffer vessel.

9. The ink supply system according to claim 8, wherein the high pressure supply section includes a high pressure header tank and the low pressure supply section includes a low pressure header tank.

10. The ink supply system according to claim 9, further comprising an ink supply vessel.

11. The ink supply system according to claim 10, further comprising an ink supply vessel.

12. An ink jet printing apparatus comprising:

the ink supply system according to claim 11.

13. An ink jet printing apparatus comprising:

the ink supply system according to claim 10.

14. The ink supply system according to claim 9, further comprising an ink supply vessel.

15. An ink jet printing apparatus comprising:

the ink supply system according to claim 14.

16. An ink jet printing apparatus comprising:

an ink supply system according to claim 9.

17. The ink supply system according to claim 8, further comprising an ink supply vessel.

18. An ink jet printing apparatus comprising:

the ink supply system according to claim 17.

19. An ink jet printing apparatus comprising:

the ink supply system according to claim 8.

* * * * *